US006229132B1

(12) United States Patent
Knetter

(10) Patent No.: US 6,229,132 B1
(45) Date of Patent: May 8, 2001

(54) SPORTING EQUIPMENT WARMER HAVING A MICROWAVEABLE HEAT SOURCE

(76) Inventor: Brian P. Knetter, P.O. Box 309, Medina, ND (US) 58467

( * ) Notice: Subject to any disclaimer, the term of this patent is extended or adjusted under 35 U.S.C. 154(b) by 0 days.

(21) Appl. No.: 09/302,342

(22) Filed: Apr. 29, 1999

Related U.S. Application Data

(60) Provisional application No. 60/083,855, filed on May 1, 1998, provisional application No. 60/104,007, filed on Oct. 13, 1998, and provisional application No. 60/115,729, filed on Jan. 12, 1999.

(51) Int. Cl.[7] ..... H05B 6/64

(52) U.S. Cl. ..... 219/759; 126/263.01

(58) Field of Search ..... 219/529, 759, 219/736, 745; 126/263.01, 204; 99/DIG. 14

(56) References Cited

U.S. PATENT DOCUMENTS

| | | | | |
|---|---|---|---|---|
| D. 370,706 | * | 6/1996 | Mulvey | D23/314 |
| 2,802,091 | | 8/1957 | MacKendrick . | |
| 3,091,681 | | 5/1963 | Mayer . | |
| 3,683,155 | | 8/1972 | Loofbourow . | |
| 3,707,279 | | 12/1972 | Kaiser . | |
| 4,049,949 | | 9/1977 | Fitzsimons . | |
| 4,155,002 | | 5/1979 | Cohen . | |
| 4,420,681 | | 12/1983 | Arnold . | |
| 4,537,313 | | 8/1985 | Workman . | |
| 4,545,362 | | 10/1985 | Hendricks . | |
| 4,880,953 | * | 11/1989 | Manker | 219/759 |
| 4,927,015 | | 5/1990 | Jones . | |
| 5,062,528 | | 11/1991 | Whitaker, Jr. . | |
| 5,070,223 | | 12/1991 | Colasante . | |
| 5,094,238 | | 3/1992 | Gibbon . | |
| 5,137,011 | | 8/1992 | Roth . | |
| 5,172,683 | * | 12/1992 | West | 126/263 |
| 5,187,814 | * | 2/1993 | Gold | 2/160 |
| 5,205,278 | * | 4/1993 | Wang | 126/263.03 |
| 5,341,927 | | 8/1994 | Coyner . | |
| 5,424,519 | | 6/1995 | Salee . | |
| 5,436,429 | | 7/1995 | Cline . | |
| 5,460,160 | | 10/1995 | Parrott . | |
| 5,478,988 | | 12/1995 | Hughes et al. . | |
| 5,484,316 | * | 1/1996 | McConnell | 460/119 |
| 5,494,598 | | 2/1996 | Hughes . | |
| 5,615,769 | | 4/1997 | Stephenson . | |
| 5,620,621 | | 4/1997 | Sontag . | |
| 5,630,961 | | 5/1997 | Salee . | |
| 5,645,749 | | 7/1997 | Wang . | |
| 5,655,328 | | 8/1997 | Childs et al. . | |
| 5,687,705 | * | 11/1997 | Blair | 126/229 |
| 5,786,574 | * | 7/1998 | Garnett | 219/529 |
| 5,834,738 | | 11/1998 | Wilson . | |
| 5,843,145 | * | 12/1998 | Brink | 607/114 |
| 5,871,527 | | 2/1999 | Gubernick . | |

OTHER PUBLICATIONS

Advertising flyer for "Hot Bat".

* cited by examiner

*Primary Examiner*—Tu Ba Hoang
*Assistant Examiner*—Jeffrey Pwu
(74) *Attorney, Agent, or Firm*—Faegre & Benson LLP

(57) ABSTRACT

A sporting equipment warmer adapted to receive a first piece of sporting equipment that imparts or receives energy to another object for raising the temperature of at least a portion of the first piece of sporting equipment. The warmer includes a rechargeable, microwaveable heat source positioned within the interior chamber of the warmer. The first piece of sporting equipment is positioned within the interior chamber of the warming shell, and the heat pack provides a source of heat energy for transfer from the heat pack to the first piece of sporting equipment. The heat pack raises the temperature of the first piece of sporting equipment through convective and conductive heat transfer mechanisms. The warming shell can be sized and shaped to accommodate a specific piece of sporting equipment, and is particularly well suited for use with a baseball or softball bat, a baseball or softball, a golf club head, or a golf ball.

11 Claims, 7 Drawing Sheets

SPORTING EQUIPMENT WARMER HAVING A MICROWAVEABLE HEAT SOURCE

CROSS REFERENCE TO RELATED APPLICATIONS

The present application claims the benefit of U.S. provisional patent application serial No. 60/083,855, filed May 1, 1998; U.S. provisional patent application serial No. 60/104,007, filed Oct. 13, 1998; and U.S. provisional patent application serial No. 60/115,729, filed Jan. 12, 1999.

TECHNICAL FIELD

The present invention is a warmer device for sporting equipment having a microwaveable heat source. More particularly, the present invention is a warmer for raising the temperature of a piece of sporting equipment that imparts or receives energy to or from an object, such as a baseball or softball bat, a baseball, a softball, a golf club head, or a golf ball, through conductive and convective heat transfer from a rechargeable, microwaveable heat source.

BACKGROUND OF THE INVENTION

Ambient air temperature can have a significant effect on the performance of pieces of sporting equipment that impart or receive energy transfer through contact with an object, such as another piece of sporting equipment. For example, in northern climates where temperatures are often cool during the early portion of a baseball or a softball season, or during evening games, cool ambient air can reduce the temperature of a softball bat, a baseball bat, a softball, or a baseball, which will have a negative impact on both the longevity and the performance of softball and baseball equipment. In particular, in aluminum bats, denting of the aluminum bats often occurs when temperatures are cool. Moreover, cold bats are more prone to stinging of a user's hands, and cold bats absorb energy as the bat strikes the softball or baseball, thereby negatively impacting the performance of the bat. Similarly, a cool softball or baseball will absorb more energy from the bat contacting the ball as compared to softballs or baseballs having a higher temperature, and thus will travel less distance in cool temperatures.

As another example, cool temperatures can negatively impact the performance of a golf club or a golf ball. During early morning or late evening hours, or generally during the spring or fall in northern climates, the cool air temperature can have a negative impact on the distance a golf ball can be struck due to the cool temperature of the golf club and/or golf ball. With respect to a golf ball, the distance a golf ball will fly and the amount of spin that a golfer can impart to the ball is generally reduced as the temperature of the ball is reduced, because the cool golf ball absorbs more energy than a warm golf ball. With respect to a golf club, again the distance a golf ball will fly and the amount of spin a golfer can impart to the ball is generally reduced as the temperature of the head of the golf club that strikes the ball is reduced.

While attempts have been made to provide warming devices that raise the temperature of certain pieces of sporting equipment, there is a continuing need for improved sporting equipment warming devices. A warming device that is portable and that permits continuous use as the piece of sporting equipment is used is desirable, as is a warming device that utilizes a rechargeable heat source. Moreover, the warmer must be effective, and must be efficient to manufacture and to use.

SUMMARY OF THE INVENTION

The present invention is a sporting equipment warmer for raising the temperature of a first piece of sporting equipment that imparts or receives energy transfer to or from a second piece of sporting equipment. The warmer is comprised of a warming shell having an interior chamber adapted to receive at least a portion of the first piece of sporting equipment. A rechargeable, microwaveable heat pack is positioned within the interior chamber of the warming shell. The heat pack raises the temperature of the portion of the first piece of sporting equipment that is received into the interior chamber of the warming shell. The heat pack is arranged for conductive contact with the portion of the first piece of sporting equipment received by the interior chamber of the warming shell. The interior chamber can be shaped to substantially conform with the shape of the portion of the first piece of sporting equipment received by the warming shell. In one such embodiment, the warming shell is shaped and sized to accommodate the barrel of a baseball or softball bat. In another embodiment, the warming shell is shaped and sized to receive a golf club head. In a third embodiment, the warming shell is shaped and sized to accommodate one or more sports balls, such as golf balls, baseball, or softballs. The warming shell can be comprised of a first layer of nylon material, a second layer of insulating material attached to the first layer of material, and a third layer of material attached to the second layer of material.

DETAILED DESCRIPTION OF THE PREFERRED EMBODIMENTS

With reference to the Figures, a variety of embodiments of a sporting equipment warmer in accordance with the present invention are shown. Generally speaking, sporting equipment warmers in accordance with the present invention include a warming shell that has an interior chamber into which a rechargeable heat pack is positioned. The warmer is preferably designed to be used with a specific piece of sporting equipment, and thus the interior chamber can be shaped to generally conform with the shape of the piece of sporting equipment. More preferably, the interior chamber is sized to primarily accommodate the heat pack and the piece of sporting equipment. In this manner, the piece of sporting equipment and the heat pack substantially fill the interior chamber of the warmer, which reduces "dead air" space in the warmer and increases the efficiency of the heat transfer from the heat pack to the piece of sporting equipment. While the term "sporting equipment" is used to refer to items used in various sporting activities, it is also contemplated that a portion of a piece of sporting equipment, such as the barrel of a bat or the head of a golf club, can be positioned within a warmer. Embodiments illustrating such warmers are described in greater detail below.

Figure 1:
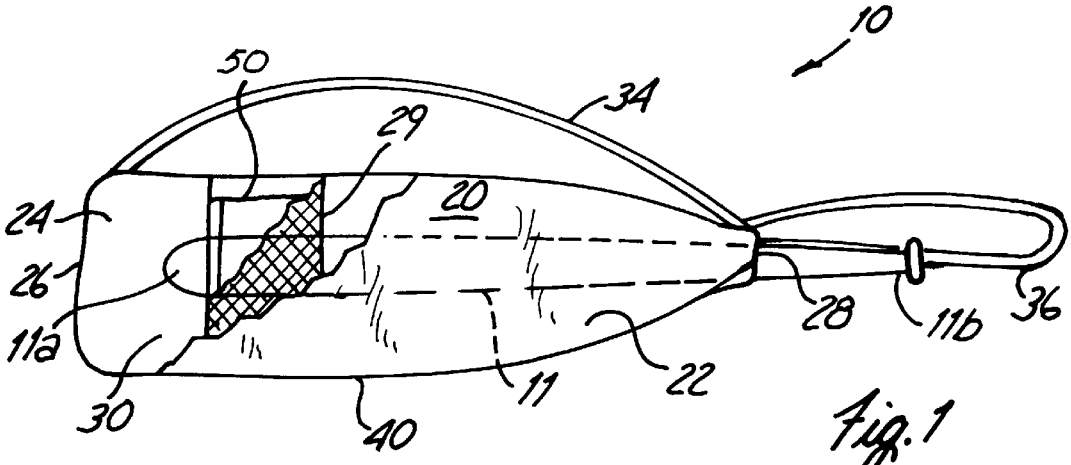
FIG. 1 is a top plan view of a sporting equipment warmer having a microwaveable heat pack in accordance with the present invention in use with a baseball or softball bat, with portions broken away to illustrate the heat pack in an interior chamber.
Figure 2:
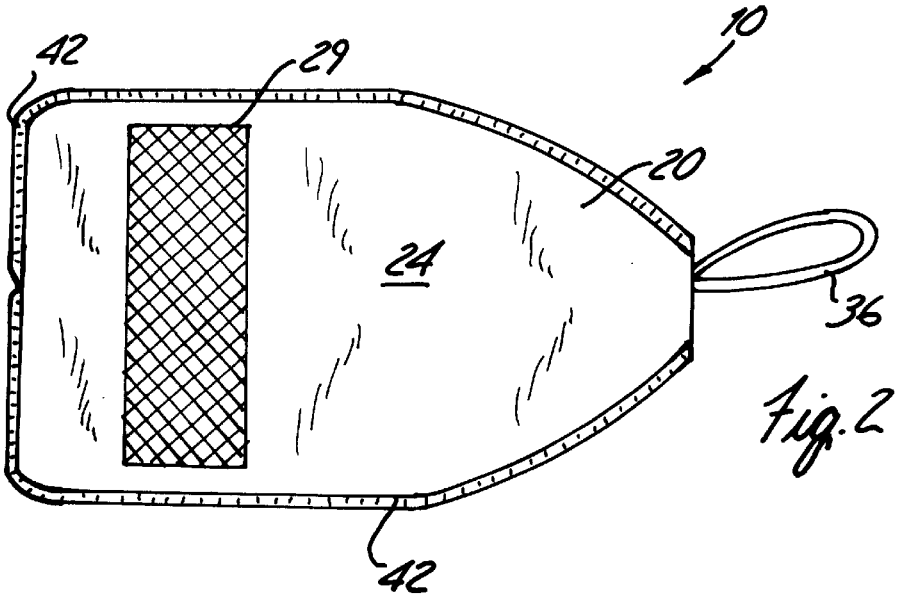
FIG. 2 is the bat warmer shown in FIG. 1 in an open position.
Figure 3:
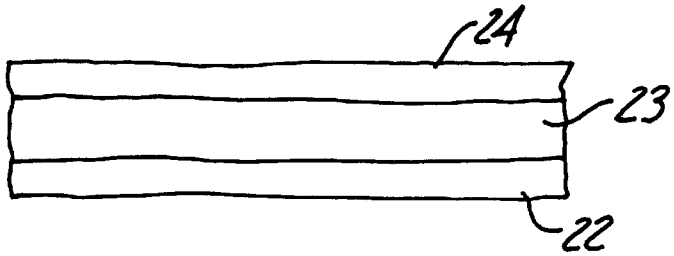
FIG. 3 is a cross sectional view of a portion of a bat warmer in accordance with the present invention.

Turning now to the Figures, FIGS. 1–3 show a bat warmer 10 in accordance with the present invention that is used to raise the temperature of a softball or baseball bat 11. Bat warmer 10 comprises a warming shell 20 having an interior chamber 30. Warming shell 20 is comprised of outer surface 22 and interior chamber 30 having an inner surface 24. A heat pack 50 is positioned within the interior chamber 30. Bat warmer 10 is shaped and sized to receive the barrel end 11*a* of bat 11 in its interior chamber 30 to raise the temperature of the barrel 11*a* of bat 11, substantially through contact with heat pack 50.

More specifically, shell 20 of bat warmer 10 has a barrel end 26 and a handle end 28. In the embodiment shown, barrel end 26 of shell 20 receives the barrel 11*a* of bat 11, while handle 11*b* of bat 11 extends from an end of the handle end 28 of shell 20. A flexible, rechargeable heat pack 50 is positioned within interior chamber 30 at the barrel end 26 of bat warmer 10. In the embodiment shown, bat warmer 10 further includes a mesh pouch 29 attached to inner surface 24 of shell 20. Mesh pouch 29 preferably includes perforations, and receives and supports heat pack 50. Toward this end, mesh pouch 29 can be sewn to inner surface 24 along three edges of the pouch 29, thus leaving the fourth edge unattached to inner surface 24 to facilitate the easy removal and insertion of heat pack 50. Alternatively, individual straps, such as can be formed from cloth or an elastic material, can be used to attach heat pack 50 to inner surface 24 of shell 20. The straps can be permanently attached to inner surface 24, or can be removable at one end to facilitate the removal and insertion of heat pack 50. In addition, heat pack 50 can be permanently mounted to the inner surface 24 of shell 20 either by attaching all four edges of pouch 29 to inner surface or with the use of straps. Other techniques and devices for attaching heat pack 50 to inner surface 24 can, of course, also be used.

As perhaps best shown in FIG. 2, shell 20 of bat warmer 10 preferably includes a seam 40 formed in the shell 20 that permits the shell 20 to be "opened" to receive bat 11. A mating structure, such as a strip of velcro 42, extends along the length of seam 40. The strip of velcro 42 is used to join the seam 40 together. In this manner, the shell can be "closed" and the interior chamber 30 of shell 20 can be defined. While a strip of velcro 42 is shown as a preferred mating structure, other structures, such as a zipper, snaps, or individual tie downs, can also be used along seam 40 to join seam 40 together and thereby define interior chamber 30.

In use, heat pack 50 of bat warmer 10 is warmed to a desired temperature (as is described in greater detail below) and placed in mesh pouch 29 of shell 20. The bat 11 is then placed on inner surface 24 of shell 20, and the opposing portions of velcro strip 42 are engaged to seal seam 40. In this manner, heat pack 50 is wrapped around the barrel 11*a* of the bat 11 at the barrel end 26 of shell 20. In the embodiment shown, the handle 11*b* of the bat 11 will extend out the handle end 28 of shell 20. Heat pack 50 raises the temperature of the barrel 11*a* of the bat 11.

In the embodiment shown in FIGS. 1 and 2, mesh pouch 29 is interposed between heat pack 50 and the bat. Heat transfer from heat pack 50 to the bat thus occurs through convection across the holes in the mesh pouch 29, and through conduction directly from heat pack 50, through the material of mesh pouch 29, and to the barrel 11*a* of the bat 11 in contact with mesh pouch 29. In an embodiment of the present invention where straps are used to secure heat pack 50 to inner surface 24 of shell 20 rather than a mesh pouch 29, heat pack 50 can be placed in direct contact with the bat to primarily provide conductive heating to the bat. Such an embodiment can advantageously lead to greater heat transfer between heat pack 50 and the bat.

In a preferred embodiment, heat pack 50 is a microwaveable heating element comprised of a substance that accepts and retains energy from a microwave oven in the form of heat, and dissipates this heat energy over time through conventional heat transfer mechanisms with its surrounding environment. Such microwaveable heat packs are commercially available from Vesture Corporation, a subsidiary of R. G. Barry Corporation, of Asheboro, N.C., and are marketed under the MICROCORE® trade name. Such heat packs are preferred because temperatures in excess of 150° F. can be achieved with only 5 minutes of warming in a conventional microwave oven set at high power. When warmed in this manner and placed in shell 20 of the present invention, heat pack 50 will retain sufficient heat to warm bats for a period of approximately 4 hours, and perhaps longer. Other heat sources that provide heat transfer to a bat can of course also be used.

The use of a rechargeable heat pack, and specifically a microwaveable heat pack, has numerous advantages over the use of other heating elements. For example, the use of a non-rechargeable heating element (such a burner of some type) typically requires oxygen for the proper generation of heat. As such, non-rechargeable heating elements of this type require an external source of air for proper operation.

Such an exterior source of air, however, negatively impacts the performance of the warmer, since heat generated by the element will be wasted as it flows out of the opening in the warmer necessary to provide the exterior air for the heating element.

Moreover, a heat pack that is heated in a microwave oven conserves fossil fuels, and can be repeatedly used. The microwaveable heat pack of the present invention is thus more environmentally sound than other heating elements. In addition, the microwaveable heat pack can be much more quickly recharged as compared to other rechargeable heating elements, such as batteries.

As described above and shown in FIGS. 1 and 2, heat pack 50 can be removed from shell 20 so that heat pack 50 can be separately warmed in a microwave oven. In the embodiment where a strip of velcro 42 is used on seam 40, the entire bat warmer 10 can be placed in a microwave oven since there are no metal components on bat warmer 10. In such an embodiment, a seam 40 on shell 20 may not be necessary at all, since removal of the heat pack 50 for heating in a microwave would not be required. In such an embodiment, an opening at either the barrel end 26 or handle end 28 could be used to facilitate the insertion and removal of bat 11 for heating.

To aide in the efficiency of the heat transfer from heat pack 50 to bat 11, shell 20 is preferably constructed of material having insulating characteristics to reduce the loss of heat to the ambient air surrounding warmer 20. As illustrated in FIG. 3, bat warmer 10 is preferably comprised of three individual layers of material. Specifically, the first layer (i.e. the layer including outer surface 22) is formed from a sheet of nylon, preferably waterproof nylon pack cloth. Nylon pack cloth advantageously provides a durable substance, yet is efficient to manufacture and use. An intermediate, insulating layer 23 is attached to the nylon pack cloth layer on a surface opposite first surface 22 using conventional means, such as stitching. Intermediate layer 23 can be preferably formed from cotton batting. Cotton batting layer 23 can also be quilted with nylon strands, if desired. Other insulating materials that provide a balance between thermal retention and cost can also be used. Inner surface 24 is formed in a layer of polar fleece material that is attached to the intermediate layer 23 of cotton batting using conventional methods, such as stitching. Other methods for forming the three layer structure can of course be used, such as heat sealing or adhesive.

As mentioned above, warmer 10 is preferably sized so that the heat pack 50 and bat 11 substantially fill the interior chamber 30 of shell 20 to reduce the "dead air" in the warmer. In the embodiment shown in FIGS. 1 and 2, then, shell 20 of bat warmer 10 is approximately 24" long as measured from the barrel end 26 to the handle end 28 of shell 20. The bat warmer is preferably 6½" in width to accommodate the barrels of conventional, standard bats. In its open shape, such as is shown in FIG. 2, the width from the edges of the seam 40 is between 13" and 15". Heat pack 50 is preferably 7" by 11" in size.

These dimensions for a preferred embodiment of bat warmer 10 are provided as an example only. Other sizes and dimensions of bat warmer 10 can of course be used as desired for a specific application.

Bat warmer 10 can also include any number of additional components attached to outer surface 22 of the bat warmer 10. For example, a carrying strap 34 can be attached from the barrel end 26 to the handle end 28 of shell 20 to permit the bat warmer 10 to be carried on a user's shoulder. In addition, a hook or strap structure 36 can be mounted to the handle end 28 of shell 20 to permit the bat warmer 10 to be hung from a structure, such as a chain-link backstop at a softball or a baseball diamond or a railing in a dugout. Team logos or other information can also be added to outer surface 22, such as through embossing, silk screening, embroidery, or stitching patches onto outer surface 22.

The bat warmer 10 as described herein overcomes many of the shortcomings described in the Background section of the present application. Specifically, by warming the temperature of a bat on cool evenings or during the early portion of a softball or baseball season, more consistent performance from a bat can be achieved. That is, a warm bat will provide better energy transfer between the bat and the ball that is being struck by the bat, which in turn provides better distance and velocity to the ball being struck. Moreover, heating the barrel of a bat will reduce the amount of sting provided to a user's hands. This is true when the bat that is warmed by the present invention is either an aluminum bat or a conventional wooden bat. In addition, in the case of aluminum softball and baseball bats, a warmed barrel is much less susceptible to denting. That is, a cold barrel of an aluminum bat is prone to denting when the bat strikes a ball that is traveling at high velocity, while a warmed bat is less likely to dent when impacting a high velocity projectile, such as a softball or a baseball.

A bat warmer in accordance with the present invention can also advantageously function as a bat weight that is used during warm-ups and stretching prior to using the bat. That is, the present invention, due to the heat pack located at the barrel end, uniformly positions approximately two to three pounds at barrel of the bat. As such, a user can advantageously swing the bat encased in the bat warmer to loosen the user's musculature. In this manner, both the bat and the user are properly prepared for the user's at-bat.

Figure 4:
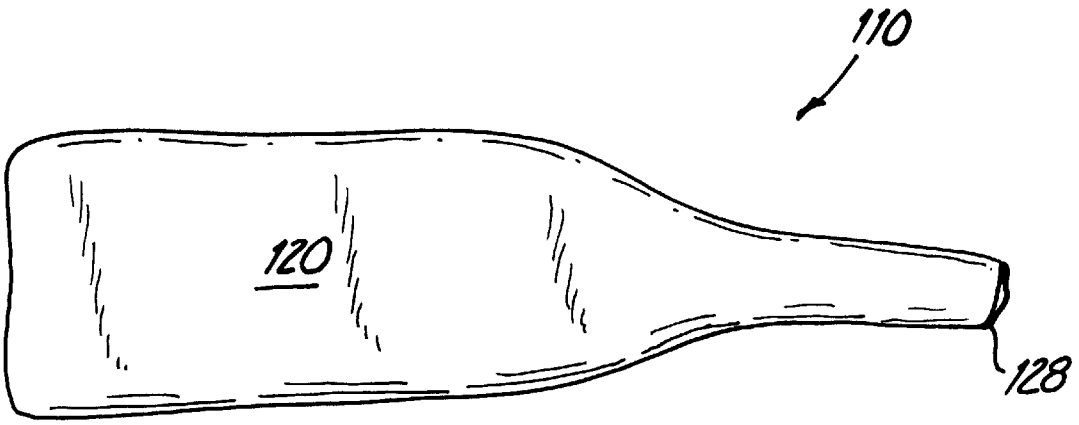
FIG. 4 is a top plan view of a second embodiment of a bat warmer in accordance with the present invention.

FIG. 4 shows a second embodiment of a bat warmer 110 in accordance with the present invention. Bat warmer 110 includes many of the features of bat warmer 10 shown in FIGS. 1 and 2 and described above. Shell 120 of bat warmer 110, however, is extended at its handle end 128 so as to encompass the entire bat within an interior chamber (not shown).

With reference to FIGS. 5–9, another embodiment of a sporting equipment warmer in accordance with the present invention is shown in use with a plurality of golf balls 214. More specifically, FIGS. 5–9 show a golf ball warmer 210 comprised of a warming shell 220 having an interior chamber 230 in which one or more golf balls 214 can be held. A heat pack 250 is positioned within the interior chamber 230, and warming shell 220 retains heat within its interior chamber 230 to raise the temperature of the golf balls 214. Golf ball warmer 210 receives one or more golf balls 214 in its interior chamber 230 to raise the temperature of the golf balls 214 through convective and conductive heating from heat pack 250.

More specifically, warming shell 220 includes an outer surface 222 and an inner surface 224. A rechargeable, microwaveable heat pack 250, similar to heat pack 50 described above in connection with bat warmer 10, is positioned within interior chamber 230 of golf ball warmer 210. In the embodiment shown, a plurality of straps 228 are attached to inner surface 224 of shell 220 to hold heat pack 250 in place. Straps 228 can be permanently attached to inner surface 224, or can be removable at one end to facilitate the removal and insertion of heat pack 250 beneath straps 228. Straps 228 are attached to inner surface 224 using conventional means, such as stitching, adhesive, or snaps, and heat pack 250 is placed under the straps 228. In this manner, straps 228 are used to secure heat pack 250 to the inner surface 224 of shell 220, yet permit heat pack 250 to efficiently be removed when necessary, such as for recharging or replacement. Other structures can, of course, be used to secure heat pack 250 to shell 220. For example, a mesh pouch that includes perforations can be sewn to inner surface 224 along three edges of the pouch, thus leaving the fourth edge unattached to inner surface 224 to facilitate the easy removal and insertion of heat pack 250, can be used. In addition, heat pack 250 can be permanently mounted to the inner surface 224 of shell 220 through the use of adhesive or other known means.

To facilitate the insertion and removal of heat pack 250 and/or balls 214 from interior chamber 230, shell 220 is provided with an opening. Toward this end, and as perhaps best shown in FIGS. 6 and 7, shell 220 of golf ball warmer 210 preferably includes a seam 240 formed in the shell 220 that permits the shell 220 to be "opened" to receive heat pack 250 and one or more golf balls 214, and "closed" to substantially seal interior chamber 230 from exterior air, and thus retain heat within interior chamber 230. In the embodiment shown, seam 240 extends around three sides of warming shell 220. A mating structure, such as zipper 242, extends along the length of seam 240. Zipper 242 is used to join the seam 240 together to close the shell 220 and thus define and seal the interior chamber 230 of shell 220. While zipper 242 is shown as a preferred mating structure, other structures, such as velcro hook and loop closures, snaps, or individual tie downs, can also be used along seam 240 to join seam 240 together and thus define interior chamber 230.

Figure 5:
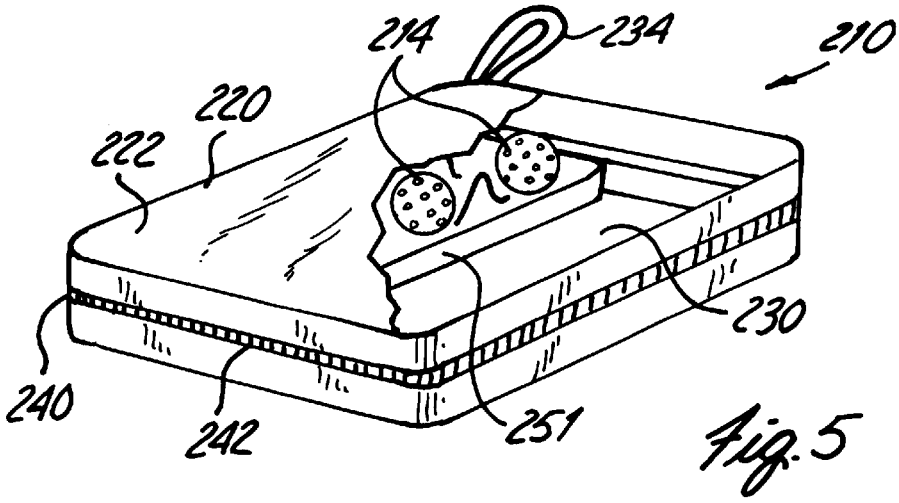
FIG. 5 is an isometric view of another embodiment of a sporting equipment warmer in accordance with the present invention shown in use with a plurality of golf balls, with portions broken away to illustrate the plurality of golf balls contained within the interior chamber of the warmer.
Figure 6:
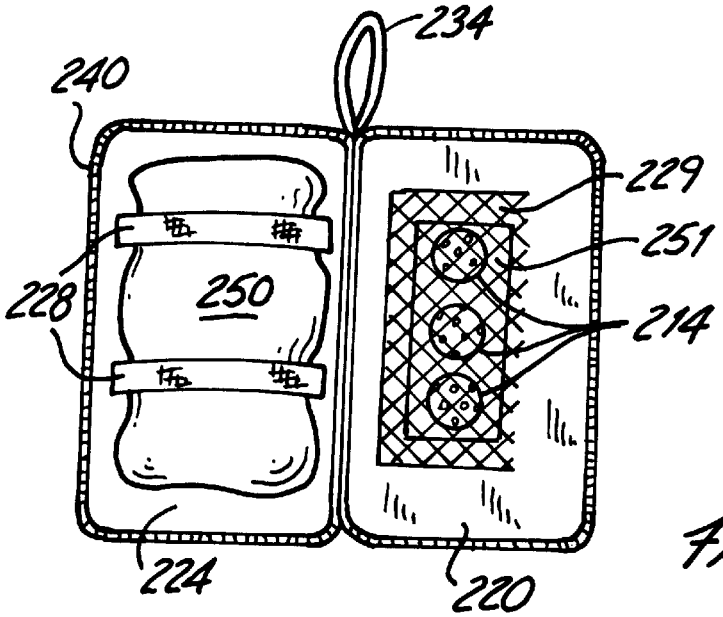
FIG. 6 is the golf ball warmer of FIG. 5 shown in an open position.
Figure 8:
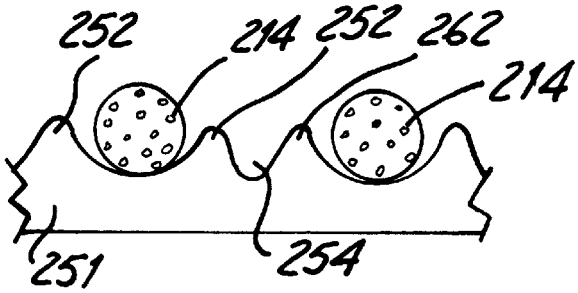
FIG. 8 is a side view of a portion of the support foam and golf balls supported by the support foam.
Figure 7:
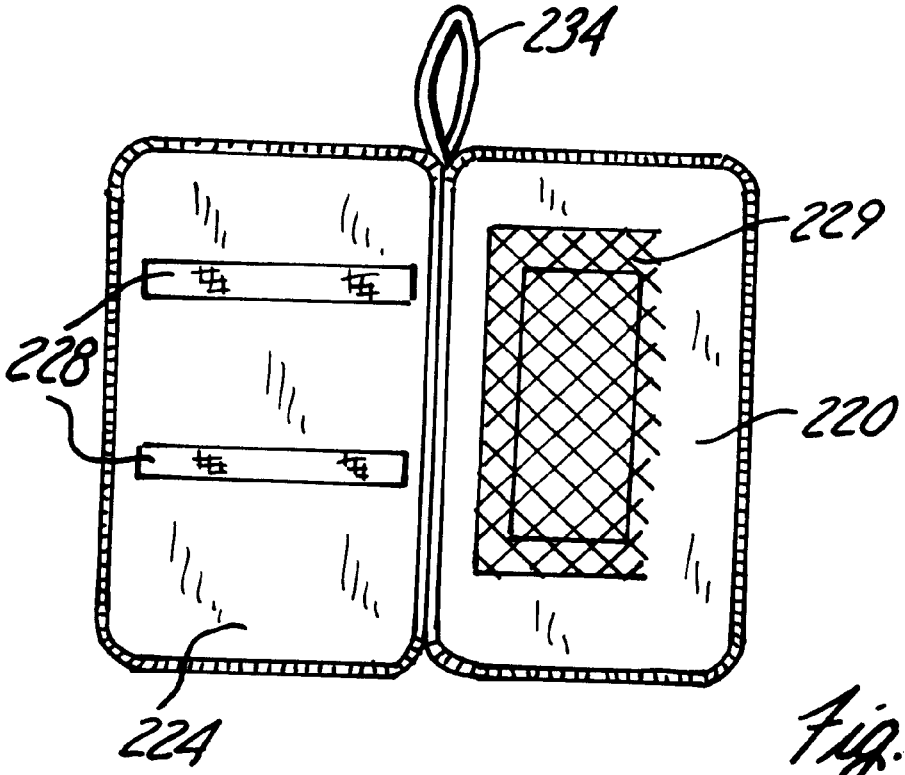
FIG. 7 is the golf ball warmer of FIG. 6 with the heat pack and foam support removed to illustrate the structure for securing these components to an inner surface of the golf ball warmer.

One or more golf balls 214 are received within interior chamber 230 of golf ball warmer 210, and in the embodiment shown in FIGS. 5 and 6, golf balls 214 are positioned on a foam support 251. Foam support 251 can be formed from a piece of convoluted foam padding, which as perhaps best shown in FIG. 8, has a plurality of hills 252 and valleys 254. A golf ball 214 is positioned within a valley 254, and his held in place by the surrounding hills 252. In addition to supporting golf balls 214, foam support 251 acts as an insulating layer in order to better retain heat within interior chamber 230 of golf ball warmer 210.

To better secure golf balls 214 to foam support 251 and to hold foam support 251 in place within interior chamber 230, a mesh pouch 229 can be secured to inner surface 224, such as by sewing three edges of a sheet of mesh material to inner surface 224. Mesh pouch 229 includes a plurality of perforations that permit the flow of air through pouch 229, and foam support 251 can be inserted under pouch 229. Golf balls 214 can be placed on foam support 251 either before or after it is inserted in pouch 229. While the present invention shows the use of both foam support 251 and pouch 229 to secure golf balls 214 in interior chamber 230, it is to be understood that golf balls 214 can be placed directly under pouch 229 without the use of foam support 251, directly on foam support 251 without the use of pouch 229, or directly on inner surface 224 without the use of either foam support 251 or pouch 229.

Similar to heat pack 50 described above, heat pack 250 is preferably a microwaveable heat pack comprised of a substance that accepts and retains energy in the form of heat from a microwave oven, and that can be "recharged" a multiple number of times. In use, heat pack 250 of golf ball warmer 210 is warmed to a desired temperature (such as by heating pack 250 in a microwave oven as is described above). When warmed in a microwave oven and placed in shell 220 of the present invention, heat pack 250 will retain sufficient heat to warm golf balls for a period of approximately 6 hours, which is under typical conditions a sufficient amount of time for a golfer to complete a round of golf. The charged heat pack 250 is placed under straps 228 of shell 220. One or more golf balls 214 are then placed on foam support 251, which as described above can be positioned within pouch 229. The teeth of zipper 242 are then engaged to seal seam 240, and thus close shell 220. In this manner, interior chamber 230 is created, the ambient air of which is heated by the presence of heat pack 250. More specifically, by sealing seam 240 and closing shell 220, heat pack 250 is brought into proximity with the golf balls 214. Heat is transferred to golf balls 214 through convective and/or conductive heat transfer mechanisms (as is described above), and the temperatures of golf balls 214 are thus increased, which in turn increases the performance of the balls. When a golfer is in need of a golf ball 214, zipper 242 can be opened to provide access to interior chamber 230, and a golf ball 214 can then be removed.

Similar to the bat warmer 10, heat pack 250 of golf ball warmer 210 can be removed from shell 220 so that heat pack 250 can be separately warmed in a microwave oven apart from the other components of golf ball warmer 210. Alternatively, the entire golf ball warmer 210 can be heated in a microwave oven without the removal of heat pack 250 so long as no metal is included on the golf ball warmer 210. That is, zipper 242 can be constructed of nylon or plastic materials, or a similar metal-less structure used to seal seam 240 such as velcro hook and loop closures or tie-downs, can be used, to obviate the need to remove heat pack 250 before recharging the heat pack. In such an embodiment the entire golf ball warmer 210 is inserted into a microwave oven.

Figure 9:
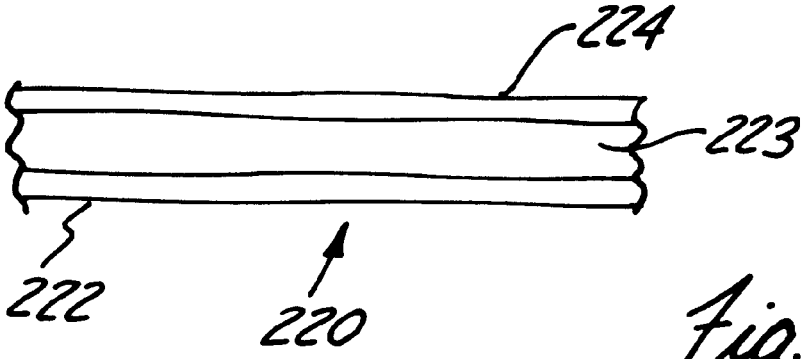
FIG. 9 is a cross sectional view of a portion of a golf ball warmer in accordance with the present invention.

As illustrated in FIG. 9, shell 220 of golf ball warmer 210 is preferably comprised of three individual layers of material. Specifically, the first layer of shell 220 (i.e. the layer including outer surface 222) is formed from a sheet of nylon, preferably 1000 denier waterproof cordura. This material advantageously provides a durable substance, yet is efficient to manufacture and use. Any other denier nylon, or any other material that is sufficiently durable, can also of course be used. An intermediate, insulating layer 223 is attached to the outer layer on a surface opposite first surface 222 using conventional means. Intermediate layer 223 acts as an insulating layer to reduce heat loss from interior chamber 230, thus increasing the efficiency of golf ball warmer 210 by increasing the amount of time heat pack 250 will heat interior chamber, and by increasing the amount that heat pack 250 can raise the temperature of the ambient air in interior chamber 230. One material well suited for intermediate layer 223 is Thinsulate® brand insulation material. Other insulating materials that provide a balance between thermal retention and cost, such as cotton batting, can also be used. Inner surface 224 is formed in a third, inner layer of material that is attached to intermediate layer 223. This third, inner layer of material is also preferably formed from nylon, such as 200 denier nylon oxford cloth. Other materials, such as polar fleece, can also be used. The outer, intermediate, and inner layers of material that comprise shell 220 can be attached to each other using conventional methods, such as stitching, heat sealing, or adhesive.

Shell 220 is preferably sized and shaped so that the interior chamber 230 is substantially filled by heat pack 250, the golf balls 214, and foam support 251. A representative example of golf ball warmer 210 is approximately 8 inches long and 5 and ½ inches wide to accommodate heat pack 250 and one or more golf balls 214. Specifically, a golf ball warmer that is 8 inches long will permit the simultaneous warming of up to 9 golf balls 214. Shell 220 is also preferably sized to have a height of 3 inches so that when closed, as shown in FIG. 5, the thickness of the heat pack 250 will snugly accommodate the golf balls 214 and the foam support 251. That is, a height of 3 inches will snugly hold these golf ball warmer components in place, without crushing the insulation of intermediate layer 223. Heat pack 250 is preferably 5" by 7" in size.

These dimensions for a preferred embodiment of golf ball warmer 210 are provided as an example only. Other sizes and dimensions of golf ball warmer 210 can of course be used as desired for a specific application.

Golf ball warmer 210 can also include any number of additional components attached to outer surface 222 of the golf ball warmer 210 to enhance its use. For example, a carrying strap 234 can be attached to outer surface 222 of shell 220 to permit the golf ball warmer 210 to be hooked onto a golf bag or on a golf cart. Information such as a golfer's monogram or other information can also be added to outer surface 222, such as through embossing, silk screening, embroidery, or stitching patches onto outer surface 222, to enhance the aesthetic appearance of the golf ball warmer 210. Similarly, welting can be added to an outer edge of the shell 220 to make the golf ball warmer 210 more attractive.

Golf ball warmer 210 overcomes many of the shortcomings described in the Background section of the present application. Specifically, by warming the temperature of a golf ball on cool evenings or during the fall or spring, more consistent performance from the golf ball can be achieved. That is, a warm golf ball will permit better energy transfer between the golf ball and a golf club that strikes the golf ball. This in turn provides better distance and velocity to the golf ball, and permits the golfer to impart a greater amount of spin to the golf ball when desired. Golf ball warmer 210 is also portable, and may be taken out on a golf course to continually warm a plurality of golf balls. Moreover, the golf ball warmer of the present invention includes a rechargeable heat pack, which reduces the costs associated with using golf ball warmer. This is particularly true in comparison to warmers that rely upon a non-rechargeable heating element to impart heat to golf balls. The use of a rechargeable heat pack is also more environmentally sound.

Figure 10:
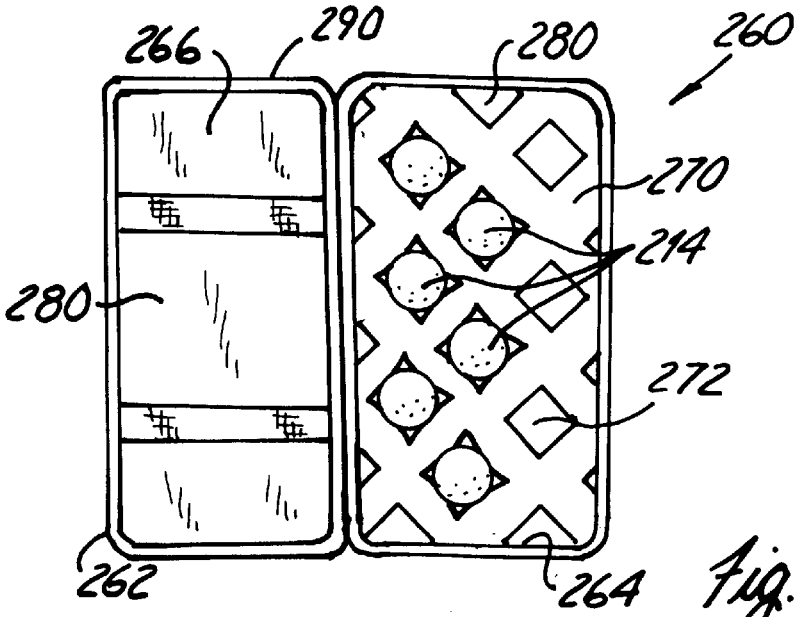
FIG. 10 is a top plan view of another embodiment of a golf ball warmer with the warming shell in an open position to illustrate elastic webbing used to support and secure one or more golf balls in the warmer.

FIG. 10 shows an alternative embodiment of a golf ball warmer 260. Golf ball warmer 260 is similar to warmer 210 described above. Warmer 260 includes a seam 290 that permits the warmer to be opened to access the interior chamber 266 of the warmer, such as for inserting or removing one or more golf balls 214. Rather than the use of a foam support, however, warmer 260 includes elastic webbing 270 that engages and supports the plurality of golf balls 214. Specifically, elastic webbing 270 is attached to inner surface 264 of warming shell 262 of warmer 260, and preferably covers the plan form shape of interior chamber 266. Webbing is arranged in a "criss-cross" pattern, and thus includes a plurality of spaces 272. Spaces 272 are sized so as to expand to receive a golf ball, and thus secure a golf ball 214 that is inserted in one of the spaces 272. In such an embodiment, a pair of heat packs 280, one on either side of the golf balls 214, can be used, in which instance a second seam (not shown) can be included for accessing the second heat pack 280.

Another embodiment of a sporting equipment warmer in accordance with the present invention is shown in FIGS. 11–14. More specifically, a warmer 310 is shown in use with a golf club 316. Golf club warmer 310 is most generally comprised of a warming shell 320 having an interior chamber 330 and a heat pack 350 that is positioned within the interior chamber 330. Golf club warmer 310 is adapted to receive a head 314 of a golf club 316 in its interior chamber 330. Golf club warmer 310 raises the temperature of head 314 of the golf club 316 through convective and conductive heating from heat pack 350.

More specifically, warming shell 320 of golf club warmer 310 is comprised of a head portion 326 and a shaft portion 328. Head portion 326 includes interior chamber 330, and a flexible heat pack 350 is positioned at a top portion of interior chamber 330 at the head portion 326 of golf club warmer 310. Shaft portion 328 is attached to the bottom end of head portion 326, and is formed from material that will stretch to permit the head 314 of golf club 316 to be inserted through shaft portion 328 and into interior chamber 330.

In the embodiment shown, head portion 326 of golf club warmer 310 is substantially tubular to accommodate head 314, and further includes a mesh pouch 329 attached to surface 324 of interior chamber 330. Mesh pouch 329 preferably includes perforations, and receives head 314 of golf club 316. Mesh pouch 329 can be attached to inner surface 324 along two side edges of the pouch 329, such as by sewing or other conventional methods, and the top edge of pouch 329 is preferably drawn together, or shut, such as by sewing or other conventional methods. The top portion of pouch 329 thus acts as a hanger structure 331, which as described below, can be used to support the heat pack 350. When formed in this manner, pouch 329 can expand to receive head 314 of golf club 316 once the head is inserted through shaft portion 328 and into interior chamber 330.

Hanger structure 331 of pouch 329 can be advantageously used to support the heat pack 350 within interior chamber 330. As described above with respect to heat pack 50 and 250, heat pack 350 is preferably formed from a microwaveable substance that is flexible in nature. As such, heat pack 350 can be suitably sized and shaped so as to be draped across hanger structure 331 of pouch 329. Because only two sides of pouch 329 are preferably attached to surface 324 of interior chamber 330, heat pack 350 will extend over the unattached sides of pouch 329, and thus substantially encircle the pouch 329, and the head 314 of golf club 316 contained therein. In this manner, heat pack 350 will provide heat to head 314, thus raising its temperature.

Other structures for receiving head 314 and/or for supporting heat pack 350 within interior chamber 330 can also be used. For example, one or more straps can be used to secure heat pack 350 to surface 324 of interior chamber 330 in a manner that encircles pouch 329. In addition, it is contemplated that golf club warmer 310 could include a flexible heat pack 350 that is attached to surface 324 in a manner that completely surrounds the head 314 of golf club 316. In such an embodiment, a mesh pouch 329 would not be required.

Figure 11:
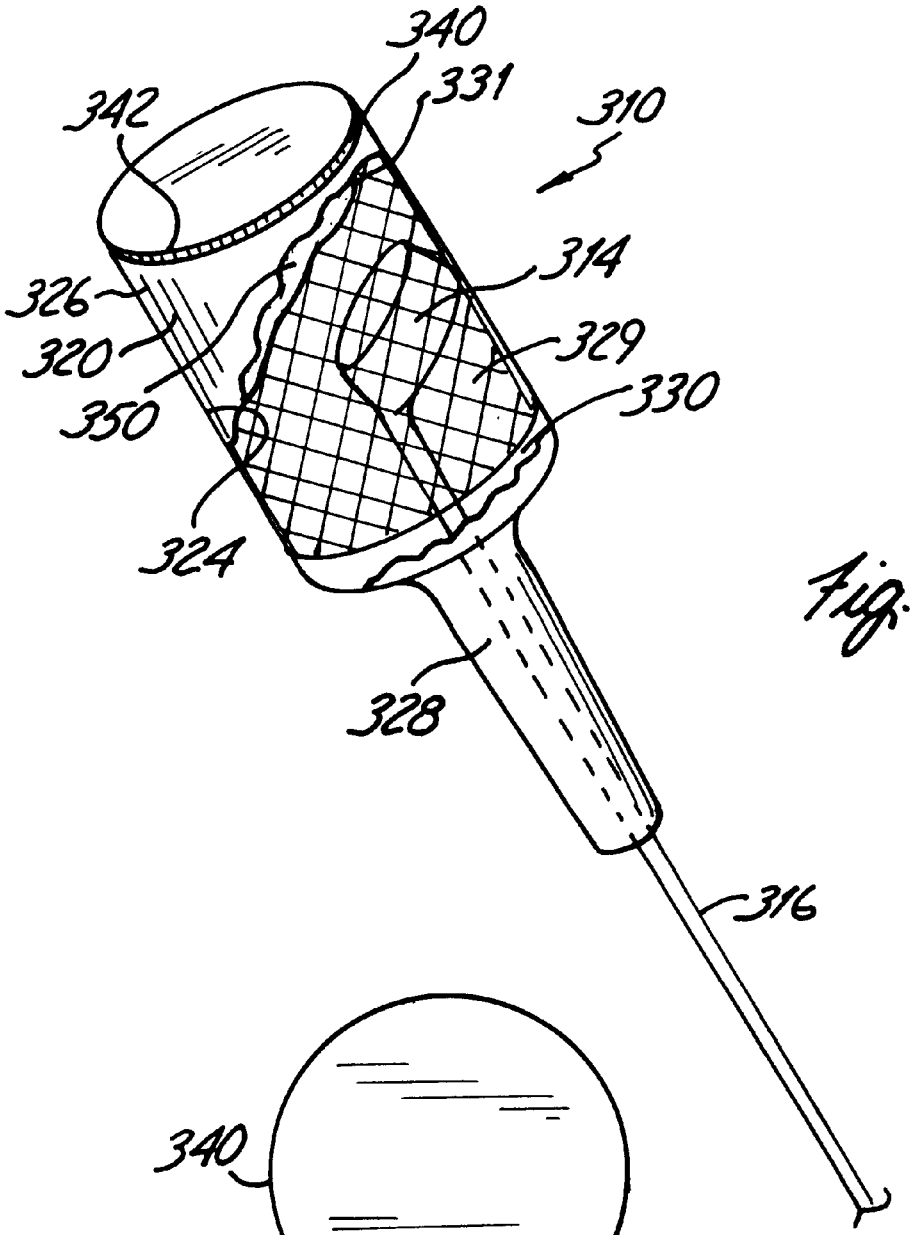
FIG. 11 is an isometric view of another embodiment of a sporting equipment warmer in accordance with the present invention shown in use with a golf club, with portions broken away to illustrate a golf club contained within the interior chamber of the warmer.
Figure 12:
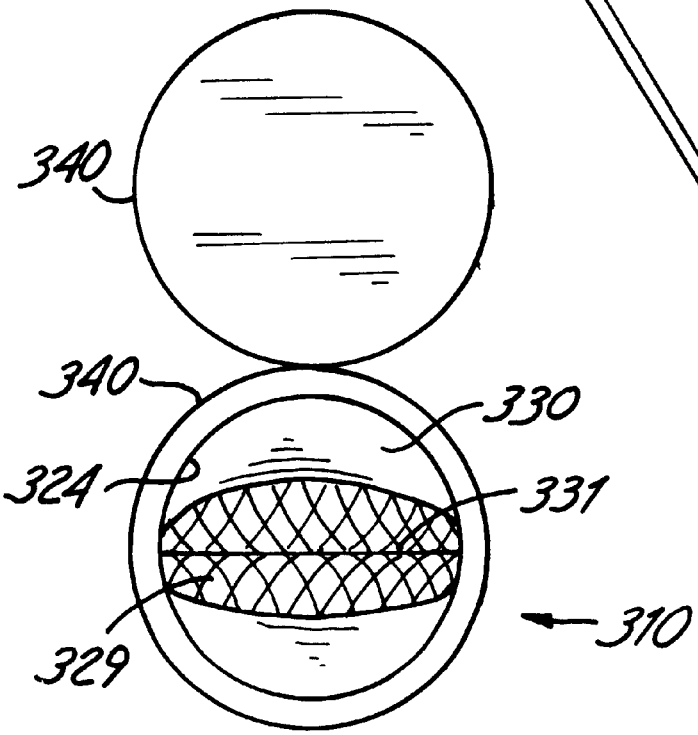
FIG. 12 is a top view of the golf club warmer of FIG. 11 shown in an open position.

As perhaps best shown in FIG. 12, warming shell 320 of golf club warmer 310 preferably includes a seam 340 formed at a top end of head portion 326 that permits the head portion 326 to be "opened" to provide easy access to heat pack 350. A mating structure, such as a zipper 342, extends along the length of seam 340, and is used to join the seam 340 together. In this manner, the top end of head portion 326 of warming shell 320 can be efficiently opened or closed to remove or insert the heat pack 350. While a zipper 342 is shown in the embodiment of FIGS. 11–13, other structures, such as a velcro material, snaps, or individual tie downs, can also be used along seam 340 to join seam 340 together and thereby provide access to heat pack 350 in interior chamber 330.

Similar to heat pack 50 and heat pack 250 described above, heat pack 350 is preferably a microwaveable heat pack comprised of a substance that accepts and retains energy in the form of heat from a microwave oven, and that can be "recharged" a multiple number of times. In use, heat pack 350 of golf club warmer 310 is warmed to a desired temperature (such as in a microwave oven described above). Temperatures in excess of 150° F. can be achieved with only 5 minutes of warming in a conventional microwave oven set at high power, and when warmed in this manner heat pack 350 can retain sufficient heat to warm a head of a golf club for a period of approximately 6 hours, which is under typical conditions a sufficient amount of time for a golfer to complete a round of golf. After being "charged" in the microwave oven, the heat pack 350 is placed over hanger structure 331 of mesh pouch 329 in interior chamber 330. Seam 340 is then sealed through the movement of zipper 342. Golf club warmer 310 can then be placed over head 314 of a golf club by inserting the head 314 of a desired club through shaft portion 328 (such as by pulling shaft portion 328 over head 314) and into pouch 329. Heat pack 350 then raises the temperature of the head 314 through conventional convective and conductive heating. When the golf club 316 is desired to be used, the golf club warmer 310 is removed by pulling the warmer 310 off golf club 316. When seam 340 is sealed and head portion 326 is closed, the top end of interior chamber 330 will prevent heat pack 350 from excessive motion as the golf club warmer 310 is placed over head 314 and removed from head 314.

Figure 13:
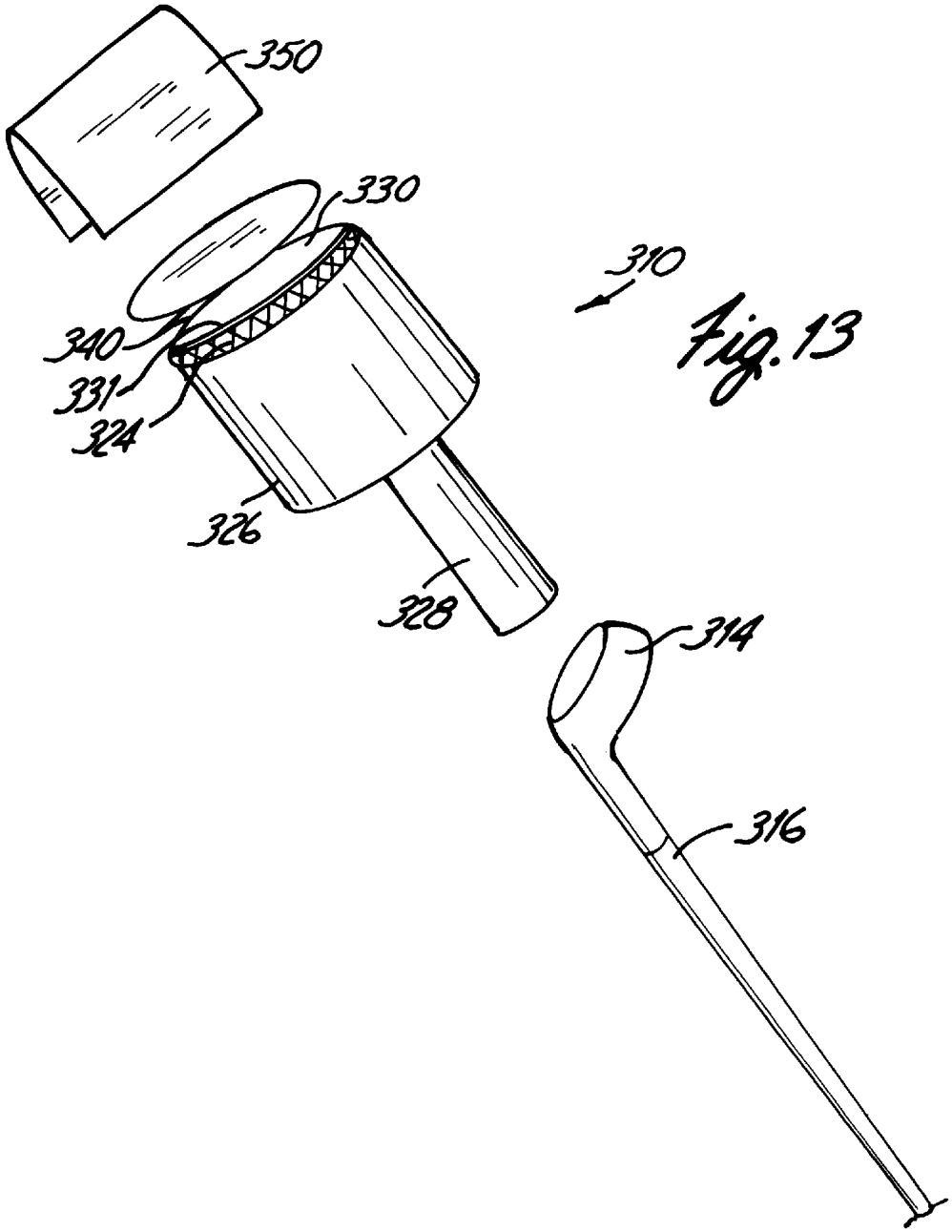
FIG. 13 is an exploded view of the golf club warmer of FIG. 11 showing the rechargeable heat source and the golf club removed from the warmer.

In the embodiment shown in FIGS. 11–13, mesh pouch 329 is interposed between heat pack 350 and the head 314, and heat transfer from heat pack 350 to head 314 occurs through two heat transfer mechanisms. First, heat transfer can occur through convection via the heated ambient air of interior chamber 330. That is, convective heating occurs from heat pack 350 to the head 314 occurs across the holes in the mesh pouch 329. Second, heat transfer can occur through conduction directly from heat pack 350, through the material of mesh pouch 329, and to the head 314 of golf club 316 in contact with mesh pouch 329. Conductive heating may also occur through direct contact between heat pack 350 and head 314 at the holes in pouch 329. In an embodiment where no mesh pouch is provided, a greater amount of conductive heating may occur due to the greater amount of direct contact between golf club head 314 and heat pack 350.

As described above and shown in FIGS. 12 and 13, heat pack 350 can be removed from warming shell 320 so that heat pack 350 can be separately warmed in a microwave oven apart from the other components of golf club warmer 310. Alternatively, the entire golf club warmer 310 can be heated in a microwave oven without the removal of heat pack 350 so long as no metal is included on the golf club warmer 310. That is, zipper 342 can be constructed of nylon or plastic materials, or a similar metal-less structure used to seal seam 340 such as velcro hook and loop closures or tie-downs, can be used, to obviate the need to remove heat pack 350 before recharging the heat pack. Alternatively, golf club warmer 310 can be constructed without a seam 340, with heat pack 350 permanently mounted to interior chamber 330. In an embodiment where the seam sealing structure is metal free or where no seam is provided for, the entire golf club warmer 310 is inserted into a microwave oven.

Figure 14:
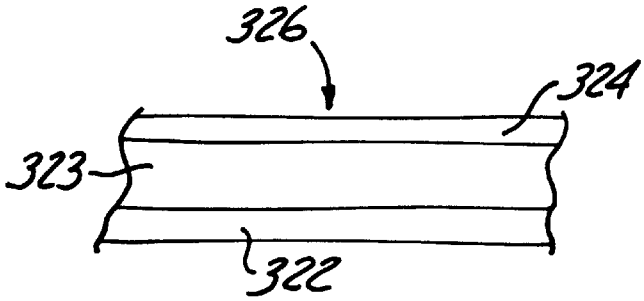
FIG. 14 is a cross sectional view of a portion of a golf club warmer in accordance with the present invention.

As illustrated in FIG. 14, the head portion 326 of golf club warmer 310 is preferably comprised of three individual layers of material. In a representative embodiment, the first outer layer 322 is formed from acrylic pile material. Acrylic pile material provides an aesthetically pleasing appearance, and is relatively durable, yet is efficient to manufacture and use. An intermediate, insulating layer 323 is attached to the outer layer 322 using conventional methods, such as stitching or adhesive. Intermediate layer 323 acts as an insulating layer to retain heat within interior chamber 330, and thus can be preferably formed from an insulating material, such as ⅝ inch foam or cotton batting. Other insulating materials that provide a balance between thermal retention and cost can also be used. Inner surface layer 324 is preferably formed from a cotton polyester material, and is attached to the intermediate layer 323 using conventional methods, such as stitching. Other methods for forming the three layer structure can of course be used, such as heat sealing or adhesive. Shaft portion 328 can be formed from any material having sufficient stretching characteristics to permit the golf club head 314 to be inserted through the shaft portion 328 and into head portion 326. The material of shaft portion 328 should also be sufficiently soft and non-abrasive so as to protect the shaft of the golf club from scratching or rubbing between the golf club and other clubs or a golf bag. One suitable material for shaft portion 328 is a cotton polyester material. Shaft portion 328 is attached to inner surface layer 324 of material using conventional methods, such as stitching or adhesive.

Golf club warmer 310 can be built in a variety of sizes and shapes to accommodate different golf club types. For example, head portion 326 can be sufficiently "over-sized" to accommodate the extra-large metal wood drivers commonly used by golfers. Alternatively, head portion 326 can be shaped to accommodate the heads of normal size woods, irons, or a putter. In this regard, the pouch 329 contained within interior chamber 330 can also be varied to provide a desired amount of snugness between the head 314, the pouch 329, and the heat pack 350. Heat pack 350 can also, of course, be provided in a number of different sizes to accommodate the different sized golf club warmers. Moreover, while only a single heat pack 350 has been illustrated, it is contemplated that a plurality of heat packs can be used if desired. For example, two heat packs that are positioned opposite each other in interior chamber 330 of golf club warmer 310 could be used. Club head 314 would then be positioned between them, and be warmed in the manner described above.

Golf club warmer 310 can also include any number of additional components attached to outer surface layer 322 of the golf club warmer 310 to enhance its use. For example, a carrying strap (not shown) can be attached to outer surface layer 322 of head portion 326 or to shaft portion 328 to permit the golf club warmer 310 to be secured to a golf bag or to a golf cart to prevent the warmer from being inadvertently lost. Information such as a golfer's monogram or other information can also be added to outer surface layer 322, such as through embossing, silk screening, embroidery, or stitching patches onto outer surface 322, to enhance the aesthetic appearance of the golf club warmer 310. Similarly, welting can be added to an outer edge of the warming shell 320 to make the golf club warmer 310 more attractive.

The golf club warmer 310 as described herein provides specific advantages and overcomes many of the shortcomings described in the Background section of the present application. Specifically, by warming the temperature of the head of a golf club, such as during cool evening or morning rounds of golf, or during the fall or spring, more consistent performance from the golf club can be achieved. That is, a warm golf club head will provide better energy transfer between the golf club head and the golf ball being struck. This in turn provides better distance and velocity to the golf ball, and permits the golfer to impart a greater amount of spin to the golf ball when desired. The application of heat from heat pack 350 to club head 314 will also speed the drying of club head 314 when it is wet, such as when it is used in the early morning when dew is present, or when used on a rainy day. This too, will permit the golfer to impart a greater amount of spin to the golf ball. Moreover, heating the golf club head may reduce the amount of sting provided to a user's hands. In addition, a warmed metal golf club head is less susceptible to denting or other abuse caused by impact with the golf ball being struck, thus lengthening the useful life of the golf club.

Golf club warmer 310 is also portable, and may be taken out on a golf course to continually warm a golf club head. It is relatively compact in size, and thus individual golf club warmers may be used for a full set of clubs at the same time. Moreover, the golf club warmer of the present invention includes a rechargeable heat pack, which reduces the costs associated with using golf club warmer. The use of a rechargeable heat pack is also more environmentally sound.

While the present invention has been described with reference to preferred embodiments, those skilled in the art will recognize that other changes can be made without departing from the spirit and scope of the present invention. For example, the present invention can be used with other pieces of sporting equipment whose performance is affected by the temperature of the piece of sporting equipment, such as, for example, a duck call or a goose call, the reeds of which are subject to freezing thus rendering the call inoperable on cold days.

Figure 15:
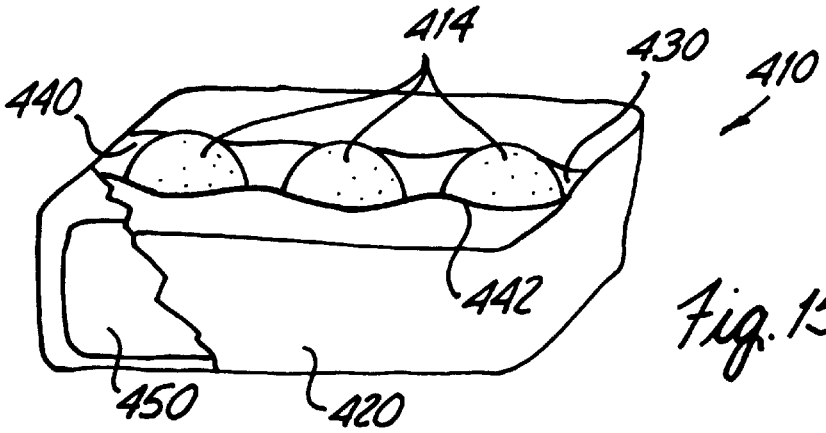
FIG. 15 is an isometric view of another embodiment of a sporting equipment warmer in accordance with the present invention shown in use with a plurality of softballs, with portions broken away to illustrate the microwaveable heat source contained within the interior chamber of the warmer.
Figure 16:
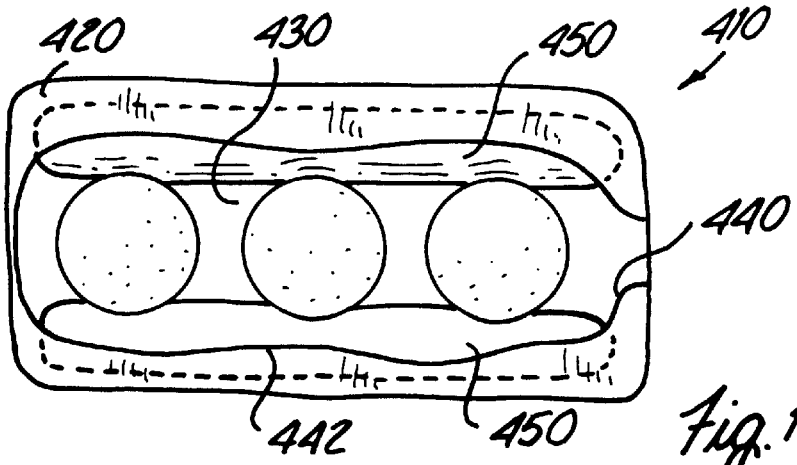
FIG. 16 is top view of the softball warmer of FIG. 15 with the seam open.

With reference to FIGS. 15–16, another embodiment of a sporting equipment warmer in accordance with the present invention is shown in use with a plurality of softballs 414. More specifically, FIGS. 15–16 show a softball warmer 410 comprised of a warming shell 420 having an interior chamber 430 in which one or more softballs 414 can be held. A heat pack 450 is positioned within the interior chamber 430, and warming shell 420 retains heat within its interior chamber 430 to raise the temperature of the softballs 414. Softball warmer 410 receives one or more softballs 414 in its interior chamber 430 to raise the temperature of the softballs 414 through convective and conductive heating from heat pack 450. While warmer 410 is shown in use with softballs 414, warmer 410 can, of course, be used with one or more baseballs to raise the temperature of the baseballs.

As with the sporting equipment warmers described above, softball warmer 410 includes a seam 440 which permits the insertion of the heat pack 450 and the one or more softballs 414. Seam 440 includes a closure device, such as a zipper 442, to permit the opening and closing of shell 420.

Heat pack 450 is a rechargeable, microwaveable heat pack, and can be charged in a microwave oven as is described above. Once charged, heat pack 450 is placed in shell 420. The size of the heat pack 450 is preferably chosen so that the heat pack 450 curves around and conforms to the shape of the interior chamber 430 of shell 420. Softballs 414 can then be inserted into shell 420, and are cradled by heat pack 450. In this manner, the softballs 414 are substantially surrounded by heat pack 450, which promotes the efficient transfer of heat from the heat pack 450 to the softballs 414.

Alternatively, a pair of heat packs 450 can be positioned within the interior chamber 430 of shell 420. Softballs 414 can then be placed between the heat packs 450 to substantially surround the balls.

Shell 420 of softball warmer 410 can be comprised of multiple layers of material, including an intermediate insulating layer formed from any of the materials described above positioned between and attached to interior and exterior layers of nylon material.

By raising the temperature of the softballs 414, softball warmer 410 overcomes many of the shortcomings described above in the Background section of the application. That is, warmed softballs will typically promote better energy transfer between the ball and the bat striking the ball, which increases the distance the ball can be hit. A warmed ball will also cause less jarring to the bat, which can reduce the sting a batter feels upon contacting the ball.

While the present invention has been described with reference to preferred embodiments, those skilled in the art will recognize that other changes can be made without departing from the spirit and scope of the present invention. For example, the present invention can be used with other pieces of sporting equipment whose performance is affected by the temperature of the piece of sporting equipment, such as a duck call or a goose call, the reeds of which are subject to freezing on cold days, which renders the call inoperable.

What is claimed is:

1. A sporting equipment warmer for raising the temperature of a first piece of sporting equipment that imparts or receives energy transfer to or from a second piece of sporting equipment, comprising:

a warming shell having open and closed states, wherein in the closed state the warming shell has an interior chamber sized and shaped to receive at least a portion of the first piece of sporting equipment; and one or more rechargeable, removable, microwaveable heat packs, each capable of being positioned within and removed from the warming shell when the warming shell is in the open state, and surrounding at least a portion of the first piece of sporting equipment when the warming shell is in the closed state, for raising the temperature of the portion of the first piece of sporting equipment received by the interior chamber of the warming shell.

2. The sporting equipment warmer of claim 1 and further including a mesh structure for removably holding the first piece of sporting equipment within the warming shell.

3. The sporting equipment warmer of claim 1 and further including straps in the warming shell for removably retaining each heat pack.

4. The sporting equipment warmer of claim 1 and further including a fastener for securing the warming shell in the closed state.

5. The sporting equipment warmer of claim 1 and further including securing structure for holding the one or more heat packs in the warming shell and enabling the one or more heat packs to physically contact and conductively heat the first piece of sporting equipment when the warming shell is in the closed state.

6. A bat warmer sized and shaped to receive a baseball or softball bat for raising the temperature of the baseball or softball bat, the bat warmer comprising:

a warming shell having a barrel portion and open and closed states, wherein in the open state a bat can be inserted into the warming shell, and in the closed state the warming shell forms an interior chamber surrounding a bat barrel; and a rechargeable, removable, microwaveable heat pack capable of being positioned within and removed from the warming shell when the warming shell is in the open state, and surrounding at least a portion of a bat barrel when the warming shell is in the closed state, for raising the temperature of the bat received within the interior chamber of the warming shell.

7. The bat warmer of claim 6, wherein the heat pack is positioned within the warming shell at the barrel portion of the warming shell, the heat pack arranged for conductive contact with the barrel of the bat received within the warming shell.

8. The bat warming apparatus of claim 6 wherein the warming shell is comprised of a first layer comprising a flexible layer of nylon, a second layer comprising an insulating layer attached to the first layer, and a third layer comprising a soft, insulating layer attached to the second layer of material.

9. The bat warmer of claim 6 and further including straps for removably retaining the heat pack in the warming shell.

10. The bat warmer of claim 6 and further including a fastener for securing the warming shell in the closed state.

11. The bat warmer of claim 6 and further including securing structure for holding the heat pack in the warming shell and enabling the heat pack to physically contact and conductively heat the bat barrel when the warming shell is in the closed state.

* * * * *